US005222598A

United States Patent [19]

Yamazoe

[11] Patent Number: 5,222,598

[45] Date of Patent: Jun. 29, 1993

[54] MULTICOMPARTMENT GOLF BAG

[75] Inventor: Wataru Yamazoe, No. 17-14, 4-chome, Todoroki, Setagaya-ku, Tokyo, Japan

[73] Assignees: Wataru Yamazoe; Takahiro Yamazoe; Makiko Yamazoe; Yuriko Yamazoe, all of Tokyo, Japan; a part interest to each

[21] Appl. No.: 625,965

[22] Filed: Dec. 11, 1990

[30] Foreign Application Priority Data

Dec. 13, 1989 [JP] Japan ..... 1-143992[U]
May 31, 1990 [JP] Japan ..... 2-57306[U]

[51] Int. Cl.[5] ..... A63B 55/02
[52] U.S. Cl. ..... 206/315.5; 224/202
[58] Field of Search ..... 206/315.2-315.8; 224/151, 202, 209, 917

[56] References Cited

U.S. PATENT DOCUMENTS

| | | | |
|---|---|---|---|
| 1,092,833 | 4/1914 | Grant | 206/315.5 |
| 1,570,500 | 1/1926 | Kennedy | 206/315.6 |
| 2,256,521 | 9/1941 | Kirkpatrick et al. | 206/315.4 |
| 2,436,687 | 2/1948 | Corbett | 206/315.6 |
| 3,259,160 | 7/1966 | Penna | 206/315.5 |
| 3,548,905 | 12/1970 | Renshaw | 206/315.3 |
| 3,622,056 | 11/1971 | Droeger | 224/209 |
| 4,282,912 | 8/1981 | Brown | 206/315.6 |
| 4,319,616 | 3/1982 | Light | 206/315.6 |
| 4,768,650 | 9/1988 | Chancellor, Jr. | 206/315.6 |
| 5,072,867 | 12/1991 | Zingale . | |
| 5,123,531 | 6/1992 | Beretta | 206/315.3 |

FOREIGN PATENT DOCUMENTS

| | | | |
|---|---|---|---|
| 0008402 | 4/1933 | Australia | 206/315.4 |
| 0364017 | 12/1931 | United Kingdom | 206/315.3 |

*Primary Examiner*—Jimmy G. Foster
*Attorney, Agent, or Firm*—Dilworth & Barrese

[57] ABSTRACT

The present invention discloses a novel golf bag provided with a pocket for receiving a golf ball, a pocket for receiving a shoulder belt, a compartment for receiving small or large golf goods and a bag made of a duplex construction for heat or cold insulation.

The present golf bag provides such advantages as case in taking out or in putting away a golf ball or shoulder belt, maintaining a beverage in a warm or cool state and further receiving golf goods into the pockets in good order.

22 Claims, 5 Drawing Sheets

MULTICOMPARTMENT GOLF BAG

FIELD OF THE INVENTION

The present invention relates to a golf bag.

BACKGROUND OF THE INVENTION

FIG. 1 is a schematic view of a conventional golf bag(60). Said golf bag is generally constituted in the form of a tube into which golf clubs are inserted. Further, a grip portion(61) and a shoulder belt(62) are mounted onto the golf bag. In general, one or a plurality of small bags(63) for receiving such small articles of golf goods as a golf ball, a glove, a tee etc are mounted at a lower end of the golf bag. Further, in the rear side of the bag, a large bag (64) is provided for receiving a comparatively large article of golf goods such as rain wear, sweaters, etc. The small bag(63) is mounted onto an external surface of the golf bag(60) and are open or closed by means of fasteners (65*a*), (65*b*) (65*c*). (In the Figure, three bags are mounted on bag (60)). The article received into the bag(60) is taken in or out from the upper part of said bag(63). The bag(63) is generally constituted by partitioning into a plurality of small bags which may be open or closed by means of respective fasteners.

The large bag (64) is mounted onto the golf bag at the rear side thereof in the form of a bag substantially along the whole surface thereof and the articles received therein are taken in or out from the side of the bag by means of a fastener provided at the side thereof (Ref. No. (66) denotes a fastener or large bag (64).

Since the aforementioned conventional comparatively small bag(63) is mounted onto the golf bag(60) at the lower end thereof, it is necessary for a golf player to take out a ball received in the bag(63) in a crouching posture or by bending the waist deeply when the golf bag stands vertically or is carried by a golf cart in somewhat inclined condition. Furthermore, when the articles are received thereinto indiscriminately, it is necessary to try to find a golf ball within the bag in the aforementioned postures. Furthermore, it is necessary to find out a desired ball in the aforementioned posture when several kinds of golf balls are received together into the bag(63).

Furthermore, when a caddie or another golf player is requested to remove a preliminary golf ball in the case where a golf ball is far from a golf player, this is troublesome to the other golf player particularly when it is not easy to find the desired ball.

Still furthermore, when the golf bag stands substantially vertical, a shoulder belt mounted thereonto hangs down due to loosening; and accordingly it is troublesome to load it onto the golf cart as it stands. Recently, the golf bag directly carried to a golf course is loaded onto the golf cart and such instances as carrying on the golf bag directly by the player or the caddie are few.

Thus, the shoulder belt becomes merely a decoration or fashion and the use thereof is considerably reduced.

For the above reason, the shoulder belt are often taken off. However, there is generally, no suitable place mounted onto the golf bag for receiving the shoulder belt thereinto and the shoulder belt thus taken off is generally pushed into the comparatively large bag(64). However, when the shoulder belt is received in the large bag(64), it becomes inconvenient to take out or place in the other articles of golf goods received thereinto.

On the other hand, it is desirous for a golf player in hot or cold season that a place suitable for receiving warm or cooled canned coffee or juice is mounted into the golf bag. Furthermore, the conventional large bag(64) is constituted lengthwise and therefore it is not easy to take out the articles received thereinto at the bottom thereof due to the articles falling down in a heap.

SUMMARY OF THE INVENTION

With the above in mind, it is an object of the present invention to provide a golf bag provided with a receiving bag for taking out or placing in an article of golf goods in an easy posture of a golf player mounted in the vicinity of at least the upper end of a small bag for receiving a small article of golf goods mounted at the lower end of the golf bag.

The other object of the present invention is to provide a golf bag capable of easily taking out or placing in a golf ball and further capable of conveniently receiving the golf ball and the administration thereof.

Another object of the present invention is to provide a golf ball provided with a shoulder bag which is not a hindrance to the use or administration of the golf bag.

Still another object of the present invention is to provide a golf bag provided with a bag for keeping such canned beverage as coffee or juice warm or cool. Still further another object of the present invention is to provide golf bag provided with receiving bag, wherein an article of golf goods received into a large bag mounted at the rear side of the golf bag can be received and classified and further will not fall down in a heap at the bottom of said bag.

The aforementioned objects can be attained by a golf bag comprising:

one or a plurality of slender bags mounted in the vicinity of a holding portion of a golf bag capable of receiving the golf ball loaded up therein in a line one by one in turn, one or a plurality of fasteners mounted onto said bag so as to allow removal of the golf balls received therein from the upper one in turn after opening said bags by means of said fasteners, an oblong bag mounted at an upper portion of a bag for receiving a small article of golf goods capable of receiving a shoulder belt folded toward one fastening means of said belt as it stands after releasing a hook engaging with the other fastening means of said belt, said oblong bag containing the fastening means of the shoulder belt therein and providing with a fastener for opening or closing the bag being mounted along the bag for receiving the small article of golf goods, an inner peripheral surface of the bag for receiving the small articles (optional bags) formed by partitioning said bag for receiving the small articles said inner bag also being lined by means of a heat insulating material so as to maintain a canned beverage warm or cool, and a large bag partitioned into two small bags provided with fasteners.

Since the bag for receiving the golf ball is mounted in the vicinity of the holding portion of the golf bag, the position for receiving the golf ball becomes high; and accordingly such inconvenience as taking out or putting away the golf ball at an unnatural posture can be eliminated. Further, since the golf balls are received vertically one by one in a line when the bag is open, the golf balls are exposed at the front of the golf bag, so that a desired ball can easily be taken out. Furthermore, one of the golf balls can be taken out by drawing down the fastener until it can be exposed. When receiving the golf ball thereinto, the upper portion of the bag is opened to the width capable of receiving each of the golf balls by means of the fastener so as to receive the balls thereinto in turn from the upper side thereof, so that the balls can be loaded one by one in a line from the bottom of the bag. By employing a double fastener capable of opening or closing action from the upper or lower side thereof, the desired balls loaded therein can be taken out either from the upper or lower position.

Furthermore, it is possible to receive the golf ball into the bag by classifying new and old ones by mounting two receiving bags in parallel.

The inner peripheral surface of the bag for heat or cold insulation is lined by a heat insulating material so as to keep the cool or warm canned beverage received thereinto either hot or cool. Therefore, it is possible to drink the same at intervals of golf play.

By constituting said bag into a duplex construction by further detachably freely by means of a magic tape mounting an inner bag for heat or cold insulation made of a heat insulating material when the small articles of golf goods are received thereinto, it is possible to control high radiant heat due to large air quantity within the bag. At the same time, it becomes possible to carry the inner bag only or to wash it after removing.

Since the bag for receiving the shoulder belt thereinto is mounted along the upper peripheral edge of the bag for receiving the small article mounted at the front lower end of the golf bag in a manner such that fastening means of said shoulder bag is contained within said receiving belt, it is possible to receive the shoulder belt into the receiving bag in its folded condition toward the aforementioned fastening means after releasing a hook fitted to the other end of the shoulder belt from an engaging ring mounted on the golf bag. When the shoulder belt thus received is employed again, the belt is taken out of the receiving bags for respective bag. Receiving articles of golf goods are mounted at the rear of said golf bag and can receive articles in each bag, so that the the articles can be received thereinto and classified in an orderly manner. Therefore, there should be no inconvenience for taking out the article received thereinto due to falling to the bottom of the bag.

DESCRIPTION OF THE PREFERRED EMBODIMENTS

Hereinafter, embodiments according to the present invention will be described in detail with reference to the drawings.

Figure 1:
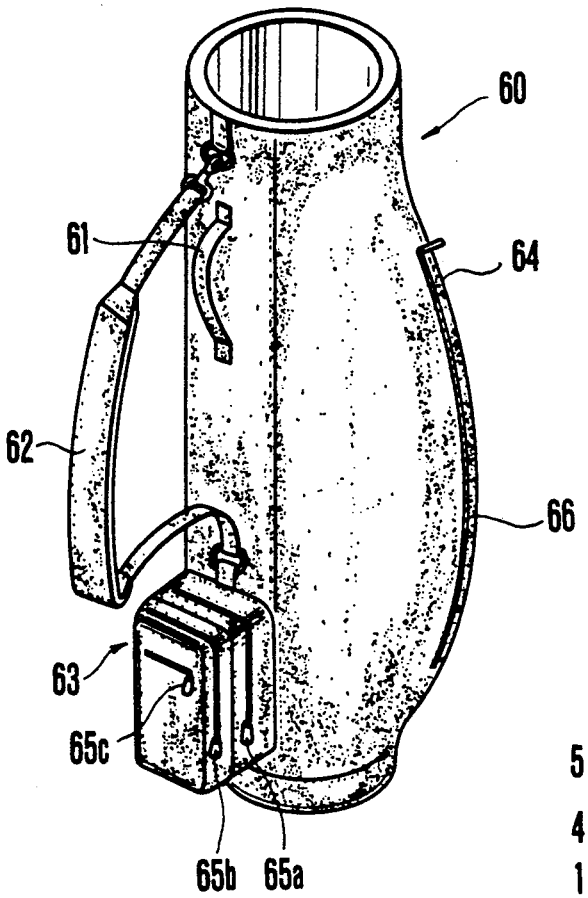
FIG.1 PRIOR ART
FIG. 1 is a schematic view of a conventional golf bag.
Figure 2:
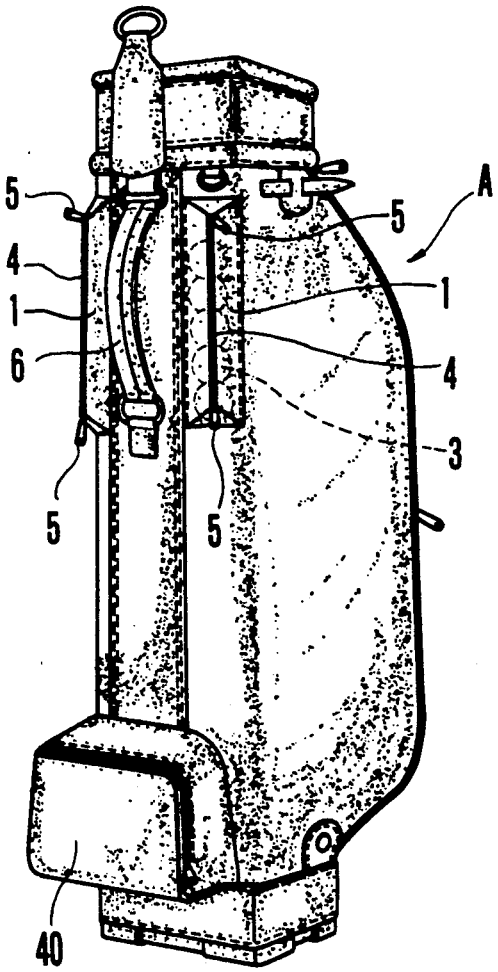
FIG. 2 is a perspective view of the golf bag(A) according to the present invention showing a mounting condition of a bag for receiving a golf ball.

FIG. 1 is a schematic view of a conventional golf bag. FIG. 2 is a perspective view of a golf bag(A) according to the present invention.

Said golf bag(A) provided with a bag (1) for receiving a golf ball mounted onto a conventional golf bag. The bag (1) is formed in the shape of a substantially lengthwise tube and has the width and length for receiving a plurality of golf balls heaped or loaded upwardly one by one in a line from the bottom.

A fastener (4) is disposed at the front of the bag (1) in the longitudinal direction. Ref. No. (5) denotes a knob of said fastener (4). By gradually drawing down the knob, balls (3) thus received are exposed one by one so as to easily remove the same. When taking out each of the golf balls, the golf ball may be exposed so as to be easily removed by drawing down the knob (5) at the fastener (4) upon opening the bag(1). When removing a desired golf ball among several kinds of golf balls, the desired ball may be taken out by opening the bag(1) to the end. Since the bag(1) is located in the vicinity of a holding portion(6) mounted at the upper front of the golf bag(A), such inconvenience as taking out the ball in a crouching posture or bending at the waist can be eliminated. Further, due to the bag(1) disposed as above mentioned, a place for receiving the golf ball becomes more definitive and such conventional trouble as trying to find the ball received within a receiving bag(40) can be eliminated . In the Figure, two bags are mounted, but one bag may be optionally mounted. By mounting two bags, new and old balls may be received in each bag under classification, for example.

According to the Figure, a double fastener capable of opening or closing the bag from the upper or lower side is naturally employed and then the golf ball can be taken out from the lower side of the bag(1).

Figure 3A:
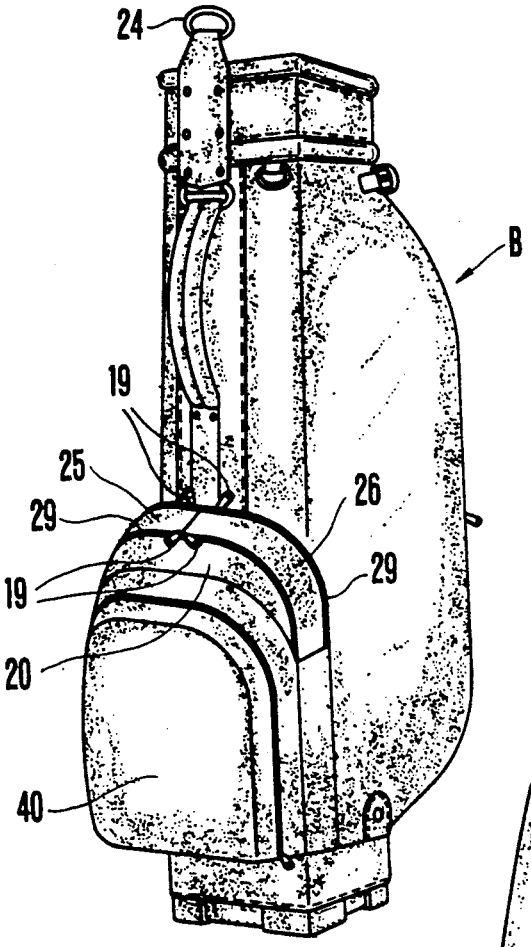
FIG. 3 (A) and (B) are a perspective view and an explanatory view of the golf bag(B) according to the present invention showing a mounting condition of the bag for receiving a shoulder belt onto said bag.
Figure 3B:
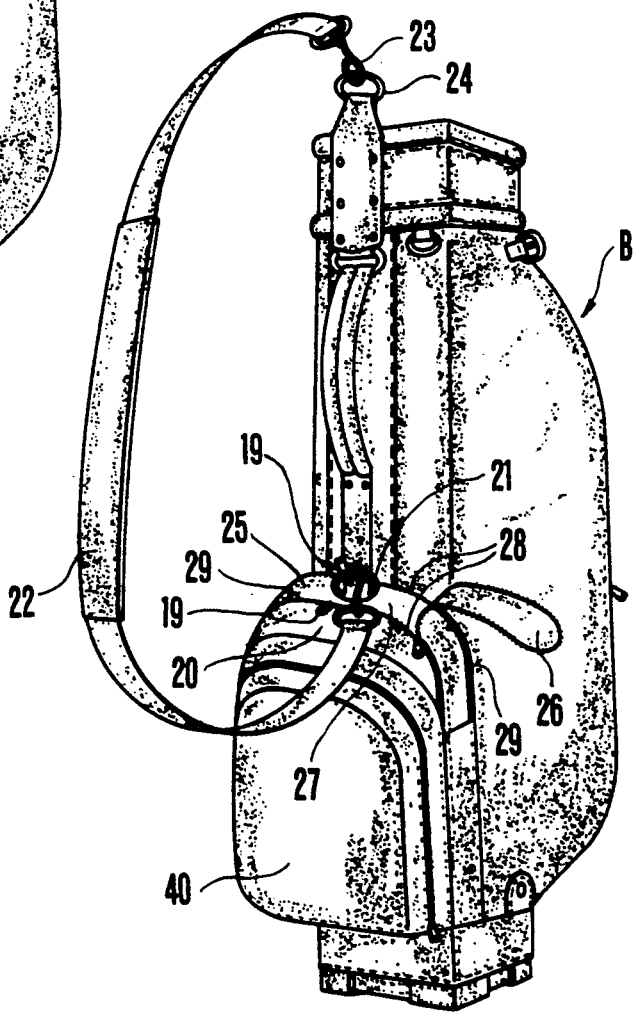

FIG. 3 illustrates a golf bag(B) according to the present invention, wherein a bag for receiving a shoulder belt(20) is mounted onto a conventional golf bag.

Said bag(20) is mounted onto the golf bag in oblong fashion at the upper portion of the bag (40) for receiving a small article of golf goods mounted at the front lower end of the golf bag. In detail, the bag for receiving the shoulder belt(22) is constituted in a manner to contain a shoulder belt fastening(21) therewithin. Further, said bag(20) has the width and length capable of receiving a folded shoulder belt toward the side of the fastening(21) after releasing a hook(23) from an engaging ring(24) at the other end of the shoulder belt (22).

The bag (20) for receiving the shoulder belt(22) consists of a receiving bag(25) and a cover(26). Said cover is arranged to open or close by means of fasteners(29)(29) disposed at both edges(28)(28) of an opening(27) of said cover(26) so as to cover said opening(27). In the Figure, the receiving bag(25) is arranged to open or close by means of the fasteners (29)(29), but said fasteners may be omitted so as to constitute a mere bag. Ref. No. (19)(19) denote knobs of the fastener.

Since the shoulder belt(22) can be received into the receiving bag(25) by folding up as above described, the golf bag according to the present invention should encounter no hindrance to loading onto a golf cart or to the administration thereof. Further, it is possible to reaffix the shoulder belt to the bag by merely engaging the hook(23) of the shoulder belt with the fastening ring(24) after taking out the shoulder belt(22) from the receiving bag(25).

Figure 4:
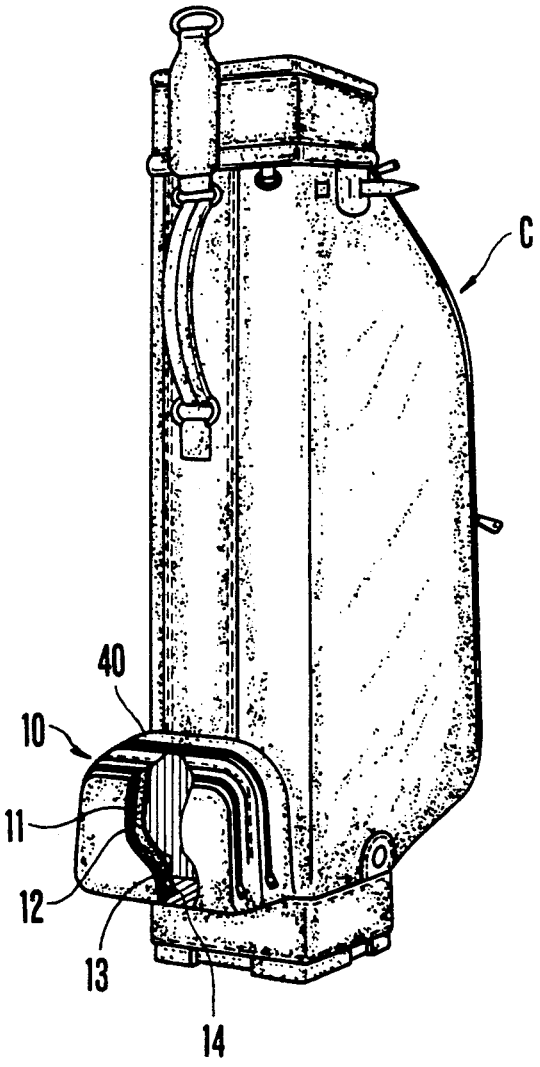
FIG. 4 is a perspective view of the golf bag(C) according to the present invention showing a mounting condition of a bag for heat or cold insulation onto said golf bag.

FIG. 4 illustrates a golf bag(C) according to the present invention, wherein a bag for heat or cold insulation(10) is mounted onto a conventional golf bag. Said bag(10) is in layered and is mounted onto the front of the bag for receiving a small article of golf goods(40) disposed at the front lower portion of the golf bag and further the inner peripheral surface thereof is lined by means of a heat insulating material.

A place of mounting the bag(10) may be optionally be selected at the front of the golf bag. The front of the bag(40) is preferable. The bag(10) is very convenient to receive cool beverage in summer or also to receive warm beverage in winter.

The shape of the bag(10) need not be limited to the aforementioned bag. It may, for example, be constituted in a manner such the inner peripheral surface of an optional bag formed by partitioning the bag(40) is lined by means of a heat insulating material so as to constitute the bag for heat or cold insulation. Alternatively, an inner bag for heat or cold insulation(70) made of a heat insulating material may further be formed within said bag(40) by mounting onto said bag(40) detachably free by means of magic tapes (72*a*)(72*b*) so as to constitute a duplex construction (Ref. No. (71) denotes a partition frame within the bag).

Figure 5:
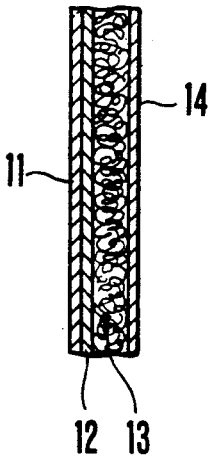
FIG. 5 is a sectional view of a heat insulation material employed in the present invention.
Figure 6:
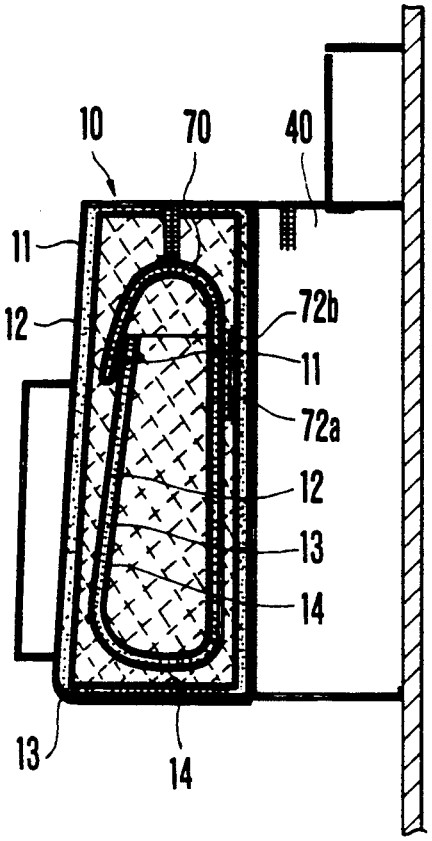
FIG. 6 is an enlarged sectional view of the bag for heat or cold insulation in FIG. 5, wherein said bag is constituted in a duplex construction.
Figure 7:
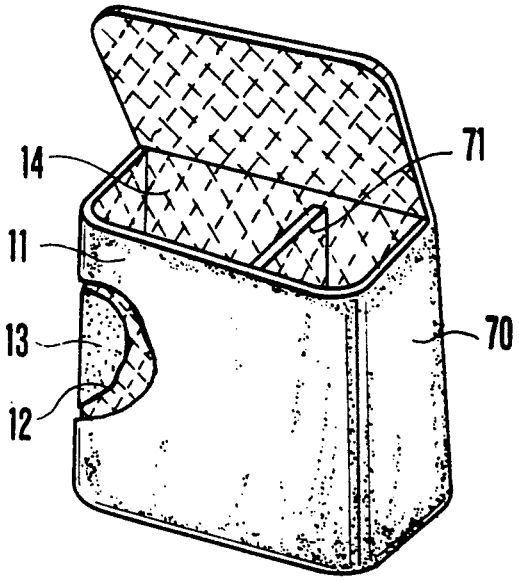
FIG. 7 is a perspective view of an inner bag as illustrated in FIG. 6.

FIG. 5 illustrates one embodiment of the heat insulating material. Ref. No. (11) denotes raw material for the bag for heat or cold insulation and ref. no. (12) denotes aluminium foil. Ref. No. (13) denotes raw material in the shape of the cotton material of polyurethane or vinyl chloride and ref. no. (14) denotes nylon fibers or, for example, polyurethane material, etc.

Figure 8:
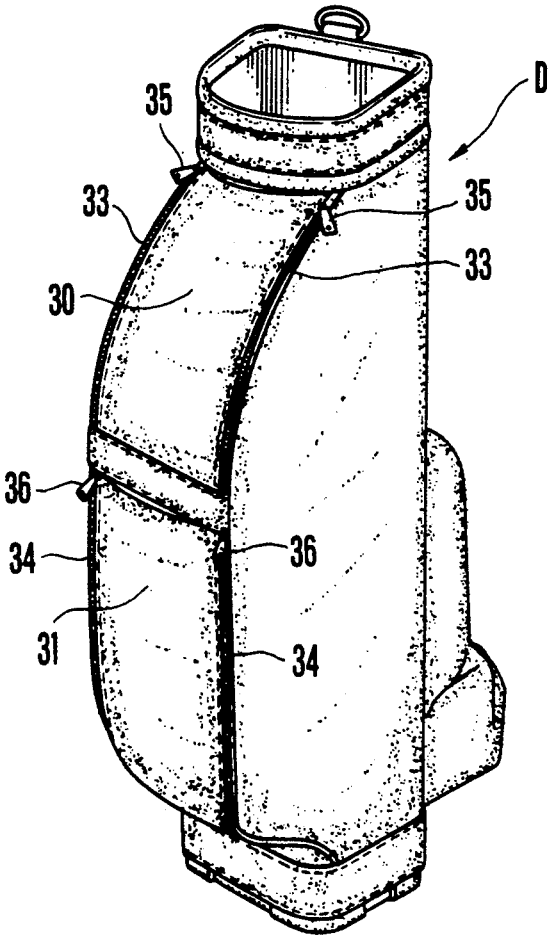
FIG. 8 is a perspective view of the golf bag (D) according to the present invention, wherein partitioned bags for receiving articles used for golf such as rainwear, etc.

FIG. 8 illustrates a golf bag(D) according to the present invention, mainly showing the rear of said golf bag. In general, onto the rear of a conventional golf gab, a large bag which is open or closed by means of a fastener disposed at one side of said bag is mounted.

According to the golf bag(D) of the present invention, the large bag mounted onto a conventional golf bag is partitioned into upper and lower bags so as to constitute an upper bag(30) for receiving an article of golf goods(30) and a lower bag for receiving a comparatively small article of golf goods(31). Ref. nos. (33)(34) denotes fasteners. Ref. Nos. (35)and (36) denotes knobs of the fasteners. By partitioning the large bag into two bags, such inconvenience as having to remove the article received at the bottom thereof can be eliminated; and further comparatively large golf goods which are frequently taken out or placed in the bag may be received into the upper bag(30).

Figure 9:
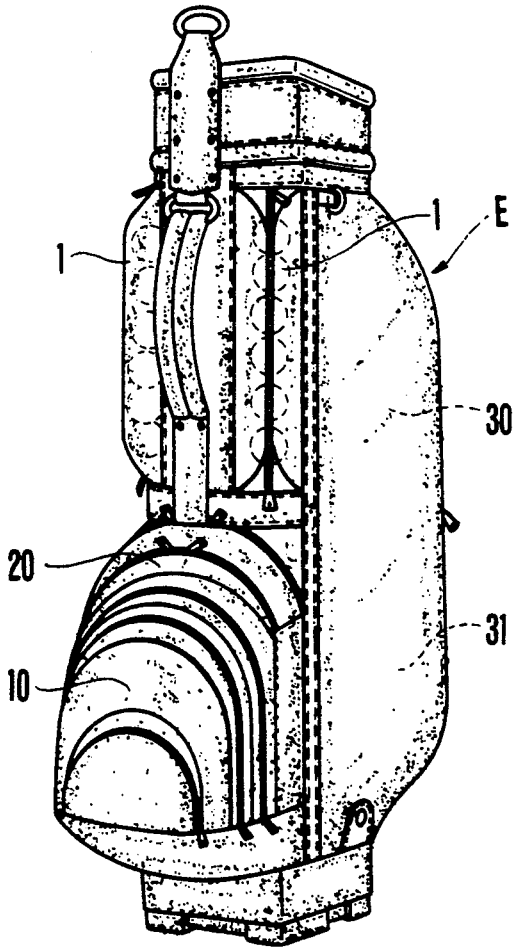
FIG. 9 is a perspective view of the golf bag(E) according to the present invention, having the bag for receiving a golf ball, the bag for heat or cold insulation, the bag for receiving shoulder belt and the bag for receiving an article used for golf.

FIG. 9 illustrates a golf bag(E) according to the present invention. The golf bag(E) comprises the bag for receiving the golf ball(1) as shown in FIG. 1., the bag for receiving the shoulder belt(20) as shown in FIG. 3, the partitioned two bags for receiving golf goods(30)(31) as shown in FIG. 8 and the bag for heat or cold insulation (10) having the duplex construction as shown in FIG. 4.

Regarding the construction of the bag for receiving the golf ball(1), the bag for receiving the shoulder belt(20) and the bag for receiving the golf goods(30)(31), they are same as above described.

As described hereinabove, according to the golf bag(A), it is quite easy to take out or place in the golf ball. According to the golf bag(B), it is easy to receive the shoulder belt into the golf bag. Further said belt can easily be received back thereinto where it was situated. According to the golf bag(C), a canned beverage can be maintained to be warm or cool as occasion demands. According to the golf bag(D), the golf goods can be received in the upper or lower bag in good order and further it is quite easy to take out the goods received in the upper bag. According to the golf bag(E), the advantages of the golf bags(A) to (C) can be obtained. Furthermore, since the inner bag is mounted detachably free due to the duplex construction, it becomes possible to carry the inner bag only or also possible to wash the same.

What is claimed is:

1. A golf bag comprising a handle mounted at an upper portion of said bag and extending in a substantially vertical direction when said golf bag is upright, at least one substantially oblong-shaped bag mounted adjacent said handle, extending in the vertical direction and arranged to receive a line of golf balls, and at least one fastener mounted upon said substantially oblong-shaped bag and arranged to allow removal of the golf balls received therein one by one by drawing said fastener up or down in said substantially vertical direction, wherein said fastener is arranged to allow removal of the golf balls received therein starting from a lower golf ball by drawing up said fastener.

2. The golf bag of claim 1, additionally comprising two substantially oblong-shaped bags mounted adjacent said handle on either side thereof, both extending in the vertical direction and each being arranged to receive a respective line of golf balls.

3. The golf bag of claim 2, additionally comprising a bag mounted at a lower end of the golf bag when the golf bag is upright.

4. The golf bag of claim 2, additionally comprising at least one fastener mounted upon each said substantially oblong-shaped bag and arranged to allow removal of the golf balls received therein one by one by drawing said fastener up or down in said substantially direction.

5. The golf bag of claim 2, additionally comprising a bag mounted at a lower end of the golf bag and partitioned into two compartments at least one which is heat insulated.

6. The golf bag of claim 5, wherein said compartments are detachable from one another.

7. The golf bag of claim 6, wherein said heat-insulated compartment is mounted detachable free by means of magic tape.

8. The golf bag of claim 5, additionally comprising a bag mounted upon the golf bag just above said partitioned bag and arranged to received a shoulder strap for the golf bag.

9. The golf bag of claim 8, wherein said bag arranged to receive the shoulder strap is substantially oblong-shaped, contains fastening means for one end of the shoulder strap and is arranged to receive the shoulder strap folded towards said fastening means thereof after releasing a hook engaging the other end of the shoulder strap with other fastening means.

10. The golf bag of claim 1, additionally comprising a bag mounted at a lower end of the golf bag and partitioned into two compartments, at least one of which is heat-insulated.

11. The golf bag of claim 10, wherein said compartments are detachable from one another.

12. The golf bag of claim 10, additionally comprising a bag mounted upon the golf bag just above said partitioned bag and arranged to receive a shoulder strap for the golf bag.

13. The golf bag of claim 12, wherein said bag arranged to receive the shoulder strap is substantially oblong-shaped, contains fastening means for one end of the shoulder strap and is arranged to receive the shoulder strap folded towards said fastening means thereof after releasing a hook engaging the other end of the shoulder strap with other fastening means.

14. The golf bag of claim 11, wherein said heat-insulated compartment is mounted detachably free by means of magic tape.

15. The golf bag of claim 1, additionally comprising a bag mounted at a lower end of the golf bag when the golf bag is upright.

16. A golf bag comprising a handle mounted at an upper portion of said bag and extending in a substantially vertical direction when said golf bag is upright, at least one substantially oblong-shaped bag mounted adjacent said handle, extending in the vertical direction and arranged to receive a lien of golf balls, and at least one fastener mounted upon said substantially oblong-shaped bag and arranged to allow removal of the golf balls received therein one by one by drawing said fastener up or down in said substantially vertical direction, wherein said fastener is arranged to be double-acting to open or close said substantially oblong-shaped bag from both upper and lower ends thereof when said golf bag is upright.

17. The golf bag of claim 16, wherein said fastener is arranged to allow removal of the golf balls received therein starting from an upper golf ball by drawing down said fastener.

18. The golf bag of claim 16, wherein said fastener comprises two knobs mounted on opposite ends of said substantially oblong-shaped bag when closed by said fastener.

19. A golf bag comprising a handle mounted at an upper portion of said bag and extending in a substantially vertical direction when said golf bag is upright, two substantially oblong-shaped bags mounted adjacent said handle on either said thereof, both extending in the vertical direction and each being arranged to receive a respective line of golf balls, and at least one fastener mounted upon each said substantially oblong-shaped bag and arranged to allow removal of the golf balls received therein one by one by drawing said fastener up or down in said substantially vertical direction, wherein said fasteners are respectively arranged to allow removal of the golf balls received therein starting from a lower golf ball by drawing up said respective fastener.

20. A golf bag comprising a handle mounted at an upper portion of said bag and extending in a substantially vertical direction when said golf bag is upright, two substantially oblong-shaped bags mounted adjacent said handle on either said thereof, both extending in the vertical direction and each being arranged to receive a respective line of golf balls, and at least one fastener mounted upon each said substantially oblong-shaped bag and arranged to allow removal of the golf balls received therein one by one by drawing said fastener up or down in said substantially vertical direction, wherein said fasteners are respectively arranged to be double-acting to open or close each said substantially oblong-shaped bag from both upper and lower end thereof when the golf bag is upright.

21. The golf bag of claim 20, wherein said fasteners are respectively arranged to allow removal of the golf balls received therein starting from an upper golf ball by drawing down said respective fastener.

22. The golf bag of claim 20, wherein said fasteners each comprise two knobs mounted on opposite ends of each said substantially oblong-shaped bag when closed by said respective fastener.

* * * * *